United States Patent [19]

Orange

[11] 4,073,403

[45] Feb. 14, 1978

[54] PUSH-IN CAN TOP

[76] Inventor: A. C. Orange, 863 Lakehaven Drive, Sunnyvale, Calif. 94086

[21] Appl. No.: 706,188

[22] Filed: July 19, 1976

[51] Int. Cl.[2] ..... B65D 41/32

[52] U.S. Cl. ..... 220/269

[58] Field of Search ..... 220/265–273, 220/277

[56] References Cited

U.S. PATENT DOCUMENTS 3,923,193 12/1976 Wells et al. ..... 220/269

*Primary Examiner*—George T. Hall

[57] ABSTRACT

An easily openable end unit for a container includes an end panel; a weakening line in the end panel defines a tear panel which may be removed at least partially from the plane of the end panel. An easily grippable push member is attached to the tear panel for rupturing it along the weakening line when pushed in a container-inward direction.

1 Claim, 6 Drawing Figures

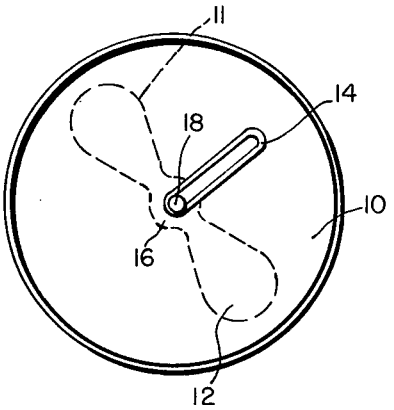
Fig.1
Fig.2
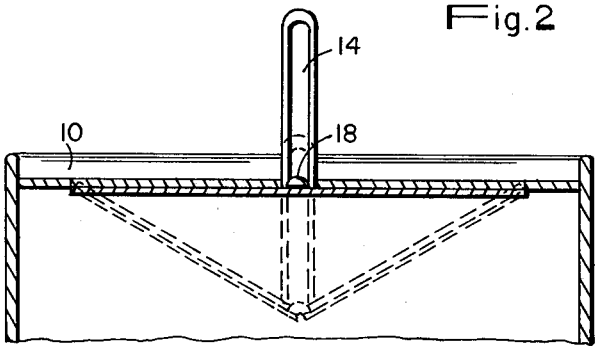
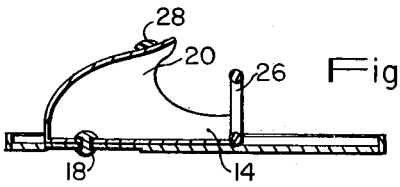
Fig.4
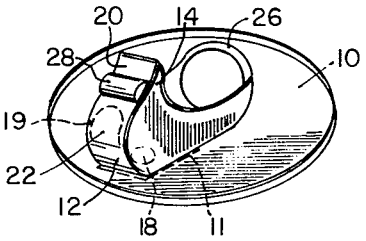
Fig.3
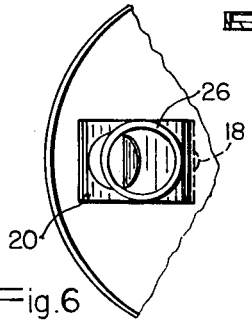
Fig.6
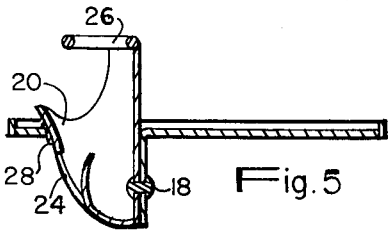
Fig.5

PUSH-IN CAN TOP

BACKGROUND OF THE INVENTION

1. Field of the Invention

The field of the present invention relates to a push-in can top.

2. Description of the Prior Art

There is known a push-button self-opener can which has one end wall with a scored tab within a central area thereof; the tab has a domed push-botton secured thereto which may be used to urge the tab downwardly so as to rip the score line. This self-opener can suffers from the disadvantage that it is difficult to apply adequate force to the push-button. There is also known a can for liquid, a pop-in container closure, an easy-open container with a non-detached tab, a container closure opening means, a sealant for pushdown gate in a can lid, a self-concealing non-detachable easy open-end device, and a double tethered push-in tab.

SUMMARY OF THE INVENTION

It is one object of my present invention to devise an easily openable end unit for a container which has a push-member which may be easily gripped; it is another object of my invention to provide a spout for the can upon the can having been opened.

I accordingly provide an easily openable end unit for a container which includes an end panel, a weakening line in the end panel which defines a tear panel which either may be at least partially removed out of the plane of the end panel, a grippable push-member for rupturing the end panel along the weakening line to push the end panel in a container-inward direction, and attachment means for joining the push-member to the tear panel. Upon the push-member being forced in the container-inward direction, the tear panel is removed out of the plane. The weakening line is substantially a figure of eight which has a central portion bulging outwardly in the plane. The push-member is a tab attached to the central portion, normally disposed substantially within the plane, and may be lifted therefrom for pushing the tear panel in the container-inward direction; the attachment means is preferably a rivet.

In another version of my invention the push-member is formed with a spout on one end thereof, and a second weakening line in the spout defines a second tear panel. The second weakening line is stronger than the first weakening line so that on pushing the second tear panel in the inward direction and following the rupture of the end panel along the first weakening line, an opening is formed in the spout along the second weakening line to admit the liquid in the container through the opening upon pouring the liquid from the spout. The spout has preferably a pull-ring on the other end thereof and a gasket is preferably attached to the spout.

BRIEF DESCRIPTION OF THE DRAWING

My invention will be better understood with reference to the accompanying drawing in which:

FIG. 1 is a perspective view of the can top, according to my invention;

FIG. 2 is an elevational view of the can top with the push-member pointing in an upward direction;

FIG. 3 is a perspective view of the can top of an alternate form of my invention;

FIG. 4 is a elevational view of the can top of FIG. 3;

FIG. 5 shows the can top of FIG. 4 after it has been pushed in an inward direction and formed a spout; and FIG. 6 is a partial plan view of FIG. 5.

DESCRIPTION OF THE PREFERRED EMBODIMENT

Referring now to the drawings, as easily openable end unit for a container includes an end panel 10, and a weakening line 11 in the end panel which defines a tear panel 12; the latter may be at least partially removed out of the plane of the end panel 10. A push-member 14 which may be easily gripped, serves for rupturing the end panel 10 along the weakening line 11 so as to push the end panel 10 in a container-inward direction; attachment means are provided for joining the push-member 14 to the tear panel 12. Upon the push-member 14 being forced in the container-inward direction, the tear panel 12 is removed out of the plane. The weakening line 11 is substantially a figure of eight, which has a central portion 16 bulging outwardly within the plane; the push-member 14 is preferably a tab attached to the central portion 16, and is normally disposed substantially within the plane. It may be lifted from the plane for pushing the tear panel 12 in the container-inward direction; the attachment means is preferably a rivet 18.

In an alternate form of my invention, the push-member 14 is formed with a spout 20 on one end thereof, and a second weakening line 19 in the spout 20 defines a second tear panel 22. The second weakening line 19 is stronger than the first weakening line 11, so that upon pushing the second tear panel 22 in the inward direction, and upon the rupture of the end panel 10 along the first weakening line 11, an opening 24 is formed in the spout 20 along the weakening line 19, which serves to admit a liquid in the container through the opening 24 upon pouring the liquid from the spout 20. For a push-pull action of the push-member, i.e., pushing it with one hand and pulling it with the other hand, the spout 20 is preferably made with a pull-ring 26 on the other end thereof, and a gasket 28 is preferably attached to the spout 20, so as to effect a good seal of the spout with the can top when pouring a liquid from the spout 20.

Although the invention has been described with respect to a preferred version thereof, it is to be understood that it is not to be so limited since changes can be made therein which are within the full intended scope of the appended claims.

What is claimed is:

1. An easily openable end unit for a container or the like comprising an end panel, a weakening line in said end panel defining a tear panel at least partially removable out of the plane of said end panel, a grippable push-member for rupturing said end panel along said weakening line to push the end panel in a container-inward direction, and attachment means for joining said push-member to said tear panel, wherein said weakening line is substantially a figure of eight having a central portion bulging outwardly within said plane, wherein said push-member is a tab attached to said central portion, normally disposed substantially within said plane and liftable therefrom for pushing said tear panel in the container-inward direction and wherein the attachment means is a rivet, whereby upon said push-member being forced in the container-inward direction said tear panel is removed out of said plane.

* * * * *